United States Patent [19]

Pryor et al.

[11] 4,141,267

[45] Feb. 27, 1979

[54] SAWMILL METHOD AND APPARATUS

[76] Inventors: Roy R. Pryor; Harold A. Pryor, both of P.O. Box 26, Woodville, Tex. 75979

[21] Appl. No.: 817,230

[22] Filed: Jul. 20, 1977

Related U.S. Application Data

[62] Division of Ser. No. 746,519, Dec. 1, 1976, which is a division of Ser. No. 470,338, May 16, 1974, Pat. No. 4,094,220.

[51] Int. Cl.[2] ..... B27B 31/02; B27B 31/04

[52] U.S. Cl. ..... 83/712; 83/708; 83/710

[58] Field of Search ..... 83/708, 710, 712, 711, 83/709

[56] References Cited

U.S. PATENT DOCUMENTS

| | | | |
|---|---|---|---|
| 1,029,482 | 6/1912 | Wilkin | 83/712 |
| 2,694,422 | 11/1954 | Doty | 83/708 |
| 2,708,467 | 5/1955 | Keeney | 83/710 |
| 3,040,788 | 6/1962 | Ross | 83/712 |
| 3,872,758 | 3/1975 | Hartzell et al. | 83/708 |

*Primary Examiner*—Donald R. Schran
*Attorney, Agent, or Firm*—Bard & Groves

[57] ABSTRACT

This invention is directed to an improved stop and loader assembly for use in a sawmill and the like, and more particularly includes an improved combination slapper bar and log turner. The combination slapper bar and log turner preferably includes a rectangular hollow slapper bar section which contains a movable member having a plurality of teeth pivotally attached thereto. A fluid-actuated piston assembly is provided for drawing the movable member and teeth longitudinally in and out of the slapper bar. A slot is further provided in the upper end of the slapper bar and adjacent any sawlog reposing on the carriage next to the slapper bar, whereby the teeth fall out of the slapper bar in an extended position to engage the log when the movable member is thrust upward in the slapper bar, and whereby the teeth fold into the slapper bar whenever the movable member is drawn downward therein.

8 Claims, 20 Drawing Figures fig.1
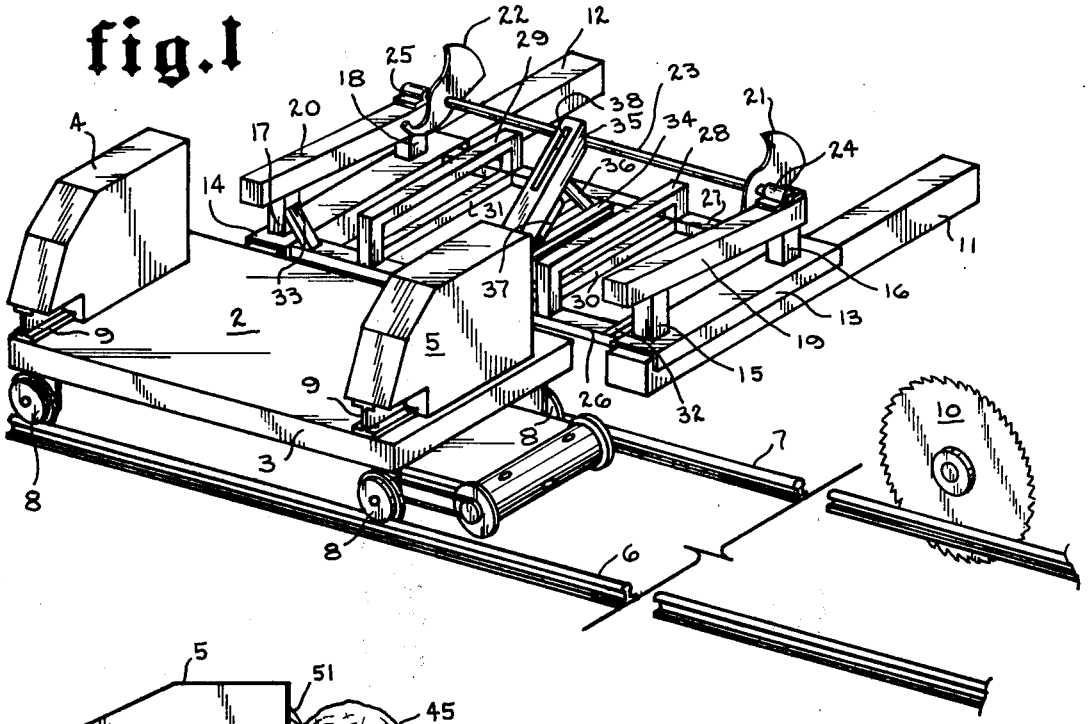
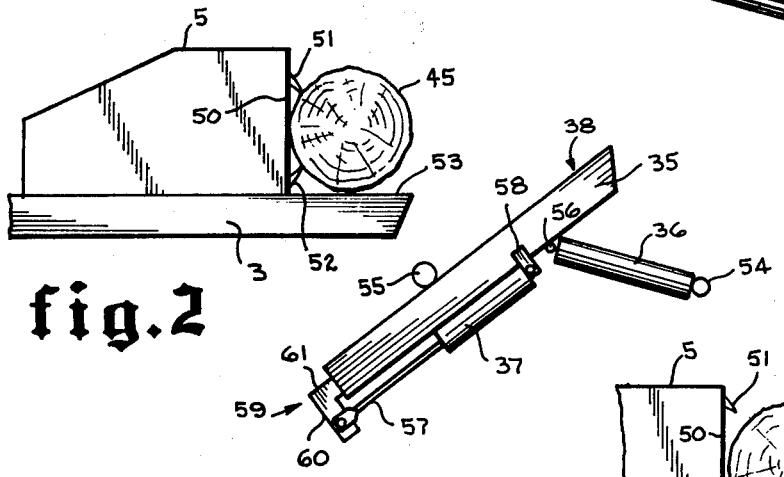
fig.2
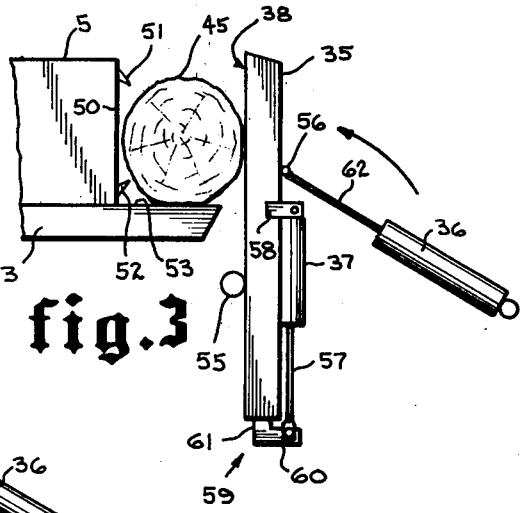
fig.3
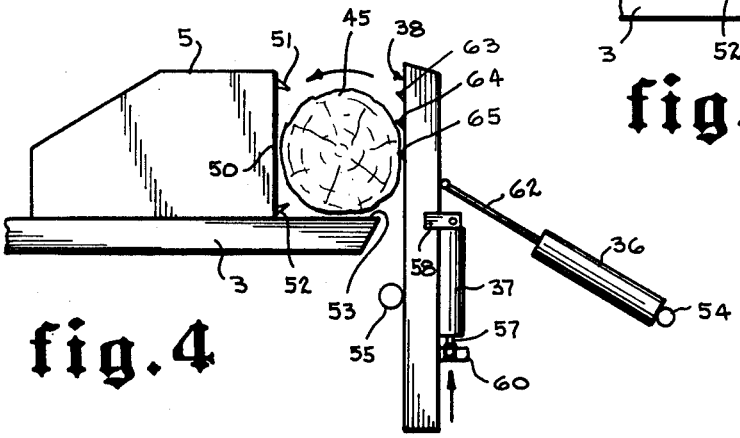
fig.4 fig.8
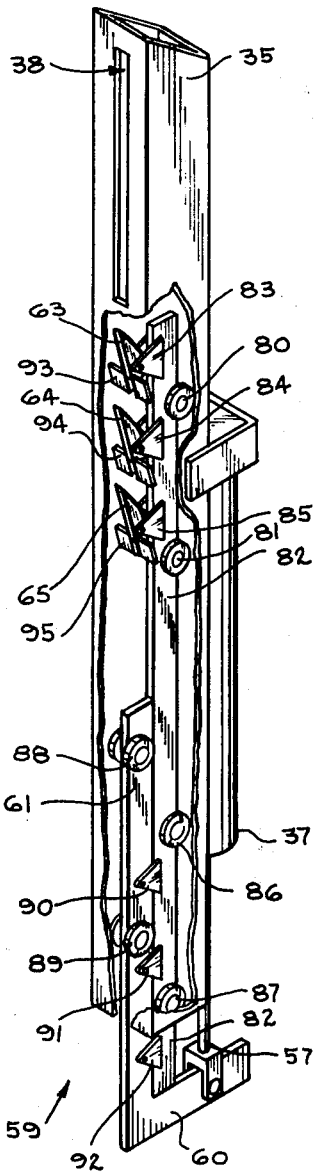
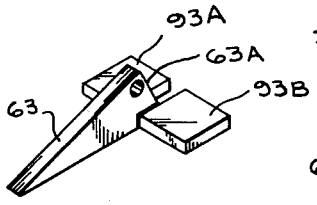
fig.11
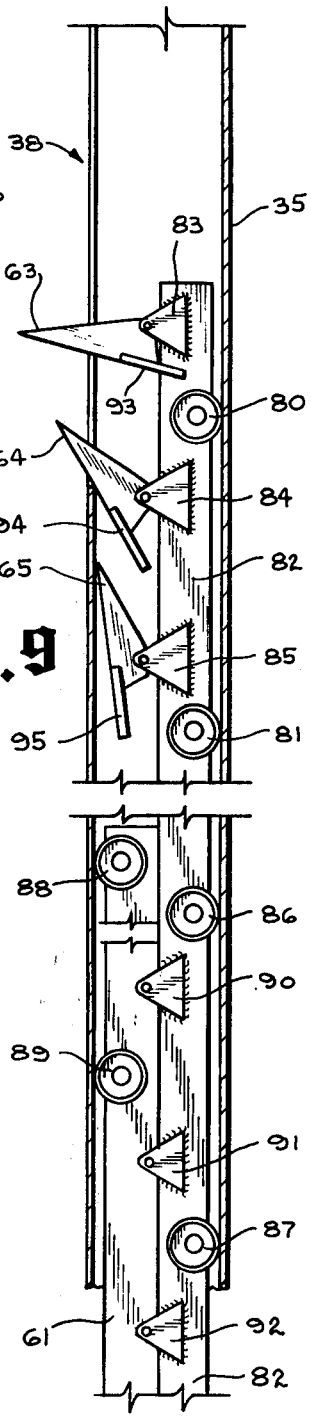
fig.9
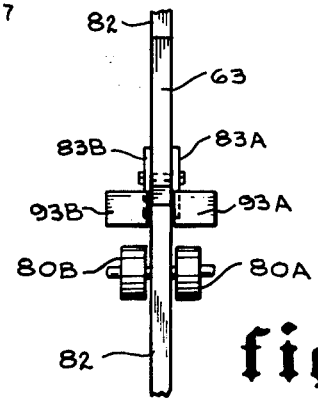
fig.10

SAWMILL METHOD AND APPARATUS

This is a division of application Ser. No. 746,519, filed Dec. 1, 1976, which in turn is a division of Ser. No. 470,338, filed May 16, 1974, now U.S. Pat. No. 4,094,220.

BACKGROUND OF INVENTION

This invention relates to improved methods and apparatus for handling saw logs and the like in a sawmill, and more particularly relates to improved methods and apparatus for receiving and transferring saw logs to the deck of the carriage assembly.

It is well known that trees are harvested for the purpose of providing either lumber or wood pulp, and that a debarked and delimbed tree will provide either a so-called "sawlog" to be cut into lumber, or a "chip log" to be cut into chips. Commercial lumber must be of a certain minimum size and length and cannot have any significant defects. Accordingly, only the straighter and longer logs of a minimum diameter can be converted into lumber. Nevertheless, the demand for lumber often exceeds the supply of good saw logs, and thus there is a need to produce lumber from logs of less than perfect configuration.

This need to utilize crooked, curved and otherwise less than perfect logs as a source of lumber is, however, counterbalanced by the fact that modern sawmills are designed to operate with a minimum amount of manual labor. Accordingly, such mills incorporate extensive conveyor and transfer devices for the purpose of receiving, stacking, loading and unloading, and conducting the logs from point to point throughout the sawmill. Even the most perfect sawlog is a relatively clumsy article because of its inherently tapered configuration, and when the log is either crooked, curved, or has flattened portions along its surface, such a log can be almost diabolical in its tendency to resist being moved in a preselected direction by mechanical means. Nevertheless, the need to accept these irregular logs has forced sawyers to tolerate frequent and costly interruptions in their operations which result when such a log shifts traversely to its intended course and causes the traditional log jam in the operation.

The seriousness of this problem cannot be fully appreciated from a consideration of economic factors alone. A juxtaposed sawlog not only restricts production by requiring the operation to be shut down until the stoppage is cleared; it also creates a very real danger to personnel since it usually can be dislodged and properly repositioned only by hand. Furthermore, the problem has been compounded in recent years by the very fact that modern sawmills are now almost fully automated, and thus there are now many more points in the operation for such stoppages to occur.

The exigencies of the situation have been met by the installation and use of special remotely controlled manipulating equipment at all of these various points in the operation, whereby a misaligned sawlog may be repositioned before it becomes wedged to cause a stoppage. Although these devices have often been effective to minimize or eliminate stoppage of the operation at many locations throughout the mill, no really satisfactory device or other solution to this problem has ever been available to handle an irregular sawlog at the place where manipulation of the log has always been a problem, i.e., at the point where the log is loaded onto the carriage which conveys it to the cutting blade.

As is more fully explained in U.S. Pat. No. 3,566,933, the conventional sawmill carriage is a flat bedded conveyance usually mounted on rails leading past a revolving circular saw blade and having two or more "knee assemblies" slidably positioned across its bed. Each of these knee assemblies is provided with a pair of dogs so that, when a saw log is dropped or rolled onto the bed of the carriage in alignment with the rails, it abuts one side of these knee assemblies and is gripped by the dogs, so that it can be held secure and immobile while being carried into the saw blade.

Although the position of the knee assemblies can be shifted traversely across the width of the carriage, it will be readily apparent that when a saw log is deposited onto the carriage it may not, and in fact often does not, align itself into proper abutting relationship to the knee assemblies whereby it can be properly and securely engaged by the dogs. Accordingly, a positioning device commonly referred to as a slapper bar is employed behind the saw log to drive it against the edges or "faces" of the knee assemblies.

As also explained in the aforementioned U.S. Pat. No. 3,566,933, a saw log is first cut on four sides to give it a rectangular configuration, before it is cut into lumber. This requires four separate trips to the saw blade, and also rotation of the log after each cut, since the position of the saw blade is fixed vis-a-vis the carriage. Although turning the saw log was historically a manual operation at this point, many devices have been adopted over the years to perform this function mechanically, and most of these devices operate quite satisfactorily with logs of traditional configuration.

The problem to which the present invention is directed arises primarily from the fact that acceptance of logs of more irregular configuration for lumbering purposes has required that the log be further manipulated after being deposited onto the carriage so that its best surface may be presented to the knee assemblies. Often the sawyer is required to turn the log several complete revolutions before this surface can be discovered, and since the log is irregular, each turn creates a tendency for the log to become misaligned and even to roll off of the carriage. Thus, the sawyer is required to continually use the slapper bar to return the log to the knees each time it is revolved, and this in turn makes the task more complex for the sawyer. Furthermore, an irregular saw log must often be held jammed up against the knee assemblies to properly secure the dogs, and thus there is often a need with irregular logs to jam the log against the knees with the slapper bar simultaneously with rotation of the log to discover and present its most advantageous side to the dogs. For this reason, there has long been a need for a suitable device which incorporates both the log turner and the slapper bar, and this need has merely been intensified by the present need to accept more irregular logs as a source of lumber.

There have been many attempts to provide a solution to this problem, but all such attempts have been either partially or wholly unsatisfactory for various reasons. In U.S. Pat. No. 189,379 (Orm), a combination slapper bar was proposed which also incorporated teeth for engaging and turning the log. In this device, however, the teeth were exposed at all times, and thus when the bar was slapped against a log with only moderate force, the teeth would either be broken or would be imbedded in the surface of the log.

In the U.S. Pat. No. 1,679,445 (Peaver), a combination log turner and slapper bar is disclosed wherein the teeth are movable within the slapper bar. In this instance, however, the teeth are not retractable, and thus this assembly suffers from the same disadvantages as have hereinbefore been set out with respect to U.S. Pat. No. 189,379.

Other similar devices are disclosed in U.S. Pat. Nos. 300,405 (Stetson), 337,705 (Rodgers), 379,086 (Torrent), 463,334 (Lange), 514,463 (Hill), 559,429 (Wilkins), 2,100,115 (Ward), 2,728,362 (Richardson), and 2,857,941 (Baker). Each of these devices either suffers from the same disadvantage, or else it is incapable of being used as either an effective slapper bar or a useful log turner. On the other hand, all of these and other disadvantages of the prior art are overcome with the present invention, and novel means and methods are provided herewith for manipulating a log both rotationally and laterally at the same time.

SUMMARY OF INVENTION

In a preferred embodiment of the present invention, an improved stop and loader assembly is provided for use in a sawmill or the like. This is a component which is usually located between the log deck and the carriage assembly for the purpose of receiving and transferring a saw log to the carriage. The basic components of a stop and loader section of generally conventional design will include a pair of generally crescent-like members arranged at the ends of a rotatable shaft, a so-called "slapper bar", and some provision for rotating a log after it has been loaded onto the carriage. The shaft is rotatable in one direction to a first whereby the two crescent members will accept a log from the log deck, and then rotatable in the opposite direction to a second to dump or roll the log toward the carriage. The slapper bar functions to drive the log onto the carriage after it has been dumped by the stop and loader members, and the log turner functions to rotate the log as desired after being driven onto the carriage by the slapper bar.

A log deck is preferably formed to move logs carried on it forward to the stop and loader section only as desired. Since a log may roll forward of its own accord to jam the mechanism, however, the stop and loader members are preferably formed to act as stops whenever they are rotated to their second position as hereinbefore described, and to accept a log only when rotated to their first or "normal" position.

It is a particular feature of such embodiment to provide a slapper bar which is mounted between the aforementioned shaft and the carriage so as to rotate arcuately behind a sawlog which is being, or has been, rolled onto the bed of a conventional sawmill carriage or the like. Accordingly, if because of an irregular configuration the log fails to roll or otherwise move fully onto the bed of the carriage and into firm abutting engagement with the knee assemblies on the carriage, or if the log bounces back away too far to be seized by the dogs, or if the log moves into a misaligned position wherein only one end is against one of the knee assemblies, the slapper bar can be swung up in a conventional manner against the log to drive it back firmly onto the carriage bed and against the knee assemblies. In contrast with conventional slapper bars, however, the apparatus of the present invention will preferably include a set of one or more tooth-like members arranged to be thrust up through the slapper bar and out through a slot in its upper end facing the log to engage its adjacent surface. If the slapper bar is raised to an elevated position and is abutting the log, raising and extending the teeth will engage the adjacent side of the log and cause it to rotate at least to the extent that the teeth may be raised.

As hereinbefore stated, it is a disadvantage of the devices of the prior art that, although the teeth may be moved up and down along the side of the slapper bar, they are nevertheless always exposed and protruding from the slapper bar toward the log. Since slapper bars must strike the sawlog with considerable violence to move such a heavy article, the teeth in these prior art devices are necessarily driven against the log with such force that they are often broken. Even when breakage does not occur, however, the impact is such as to imbed the teeth into the surface of the log to an extent such that it becomes difficult to dislodge them. Sometimes the log may be secured by the dogs so that the teeth of the log turner can be retracted when the slapper bar is pulled back into its horizontal position, but, even when this can be done, driving the teeth this deeply into the log tends to reduce its value as a source of lumber. Accordingly, it is a feature of the present invention that, in the apparatus hereinafter depicted, provision is made for withdrawing the teeth of the log turner fully within the slapper bar whenever it is desired to strike a saw log with the slapper bar.

In an ideal embodiment of the present invention, the log turning mechanism preferably includes a longitudinal member slidably located within the slapper bar and interconnected to be drawn at least partially in or out of the lower end of the bar. Moreover, the teeth hereinbefore referred to are preferably pivotally attached to the bar, whereby they fold upward against the side of the member when it is drawn down through the bar, and whereby only the surface of the bar will engage the log. In addition, the teeth are of a particular configuration whereby they will fold up into the slapper bar whenever the member is drawn downward with respect to the log, so that even when the teeth are extended from the slapper bar, they will not engage and rotate in the wrong direction. Suitable stop means are preferably included, of course, to limit pivotal movement of the teeth when engaging the log, or else the teeth would not be able to lift and rotate the log when the movable member is raised within the slapper bar.

Accordingly, the teeth of the log turner mechanism will engage and rotate the log only upon upward travel of the movable member within the slapper bar, and upon downward travel of the movable member the teeth will fold away from the log into the slapper bar. Thus, the log may be rotated through whatever number of positions may be needed for proper positioning on the carriage by merely alternating the movable member up and down in the slapper bar.

Although the mechanisms hereinafter described will show the log turning apparatus as having three spaced-apart tooth members, it should be noted that only one tooth is actually essential to produce some rotation of the saw log and that, if more than one tooth is used, as is illustrated herein, the advantage is merely that the log may be rotated through a greater angle with one upward stroke. In addition, although the mechanisms hereinafter described will further show apparatus having only a single slapper bar with a log rotating device therein, when saw logs of larger than average diameter and length are to be handled it is desirable to provide two or more such slapper bar and log rotator combinations spaced appropriately along the side of the carriage.

These and other features and advantages of the present invention will become apparent from a consideration of the following detailed description, wherein reference is made to the figures in the accompanying drawings.

IN THE DRAWINGS

FIG. 1 is a simplified pictorial representation of apparatus incorporating an exemplary embodiment of the present invention and further showing a conventional sawmill carriage arranged to receive saw logs from a generally conventional loading mechanism.

FIG. 2 is a further simplified pictorial representation of the carriage and a portion of the other apparatus depicted in FIG. 1, and more particularly showing a simplified representation of a combination slapper bar and log rotator or turner assembly embodying the concept of the present invention.

FIG. 3 is another simplified pictorial representation of the apparatus depicted in FIG. 2 and showing the combination slapper bar and log turner assembly arranged to position or hold a saw log on the bed of the carriage and against the faces of the knee assemblies.

FIG. 4 is a similar pictorial representation of the apparatus depicted in FIGS. 2–3, wherein the combination slapper bar and log rotator is arranged to rotate the log while holding it on the bed of the carriage and against the knee assemblies.

FIG. 6 is a similar pictorial representation of the combination slapper bar and log turner assembly depicted in FIG. 5, and showing how teeth on the log turner mechanism are extended to rotate a saw log or the like.

FIG. 8 is another simplified pictorial and partly cut away representation of the combination slapper bar and log turner assembly depicted in FIGS. 1–6, depicting the structural details of the log turner mechanism which are housed within the slapper bar portion of the assembly, and further depicting how the teeth portion of the log turner mechanism may be withdrawn for protection within the slapper bar portion.

FIG. 9 is a further simplified pictorial representation, partly in cross section, of the combination slapper bar and log turner assembly depicted in FIG. 8, and more particularly showing how the teeth on the log turner mechanism may be either folded within or unfolded out of the slapper bar.

FIG. 10 is a different simplified pictorial representation of a portion of the log turner mechanism depicted in FIGS. 8 and 9, and more particularly showing certain structural details of the mechanism.

FIG. 11 is a pictorial representation of an exemplary configuration of tooth preferably included in the apparatus depicted in FIGS. 1–10 herein.

Figure 12:
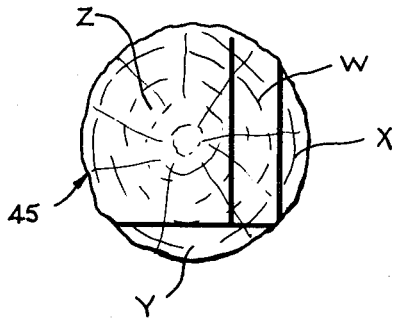

FIG. 12 is a pictorial representation of the end of a sawlog which illustrates the manner and sequence in which it is cut with apparatus working in conjunction with operation of the present invention.

Figure 13:
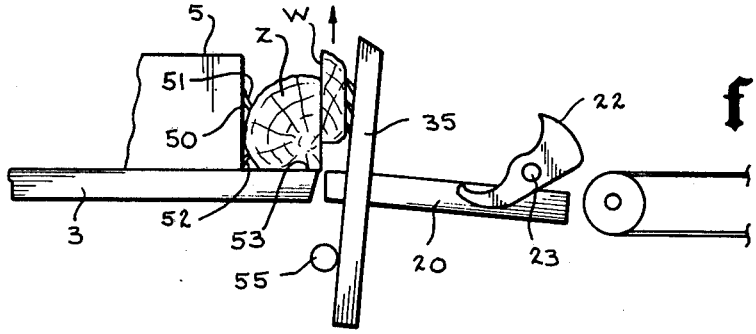

FIG. 13 is a simplified pictorial representation of the manner in which a portion of the sawlog in FIG. 12 may be manipulated with apparatus embodying the concept of the invention.

Figure 14:
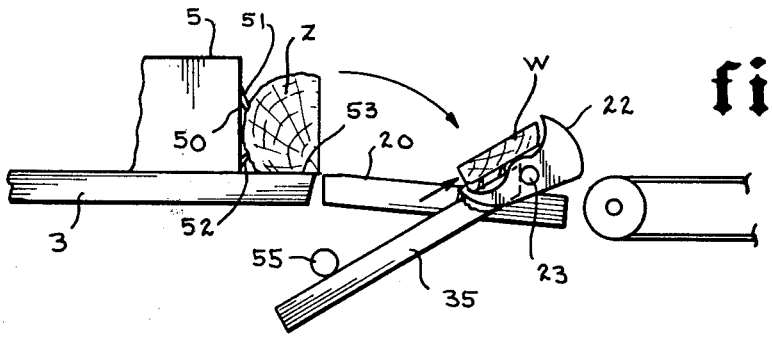

FIG. 14 is a similar representation of the apparatus in FIG. 13 showing further manipulation.

Figure 15:
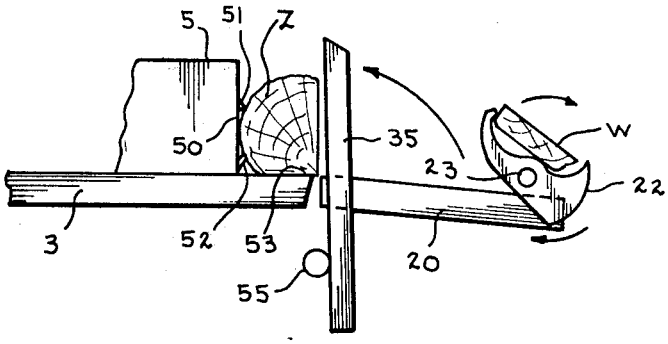

FIG. 15 is a similar representation of the apparatus in FIG. 13 showing further different manipulation.

Figure 5:
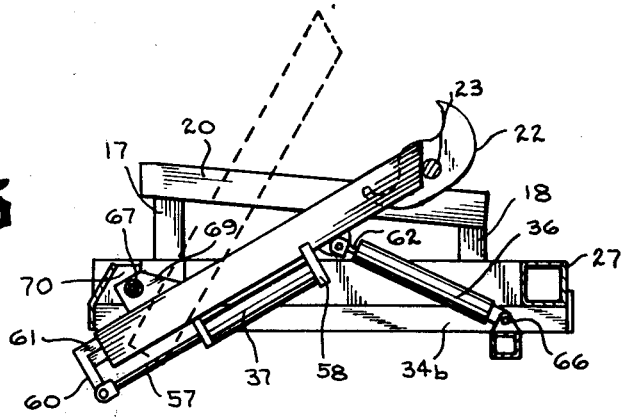
FIG. 5 is another simplified pictorial representation of the combination slapper bar and log turner assembly depicted in FIGS. 1–4, and illustrating how the assembly is elevated for the purpose of striking and moving a saw log into position.
Figure 16:
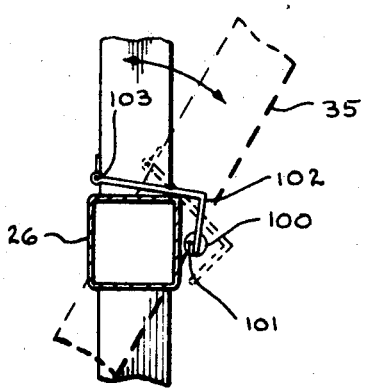

FIG. 16 is a pictorial representation of a portion of the apparatus depicted in FIG. 5, and more particularly showing means for actuating a limit switch when the slapper bar approaches an erect position.

Figure 17:
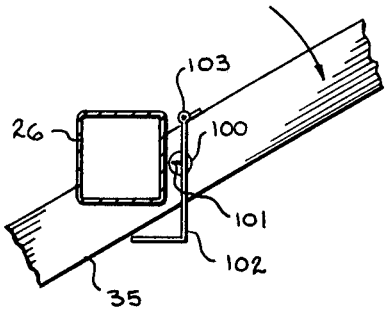

FIG. 17 is a pictorial representation of the apparatus depicted in FIG. 16, wherein the illustrated apparatus is shown in a different position.

Figure 18:
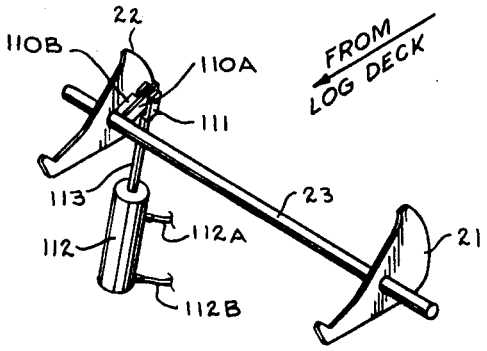

FIG. 18 is a simplified pictorial representation of the details of a portion of the apparatus illustrated in FIG. 1.

Figure 19:
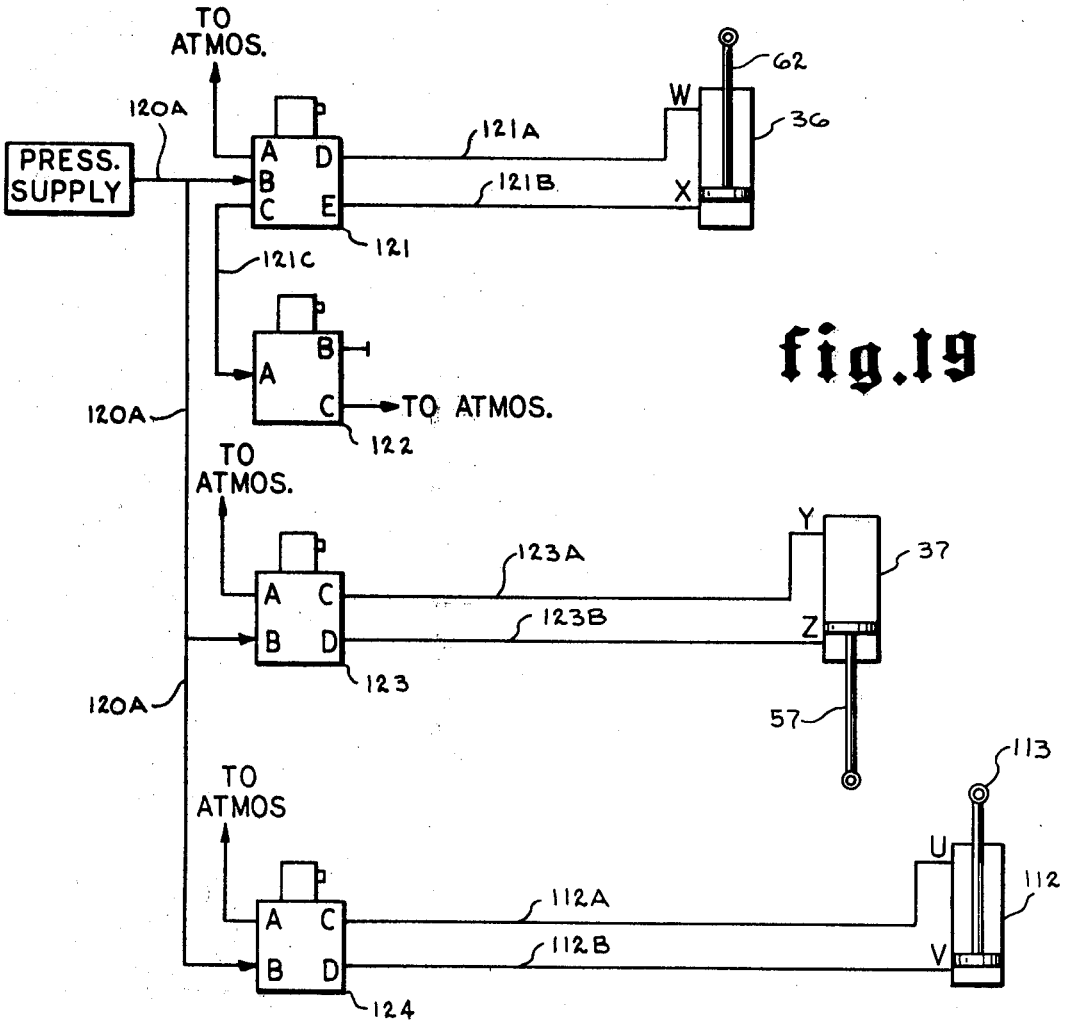

FIG. 19 is a functional illustration of an exemplary form of the actuation system employed with the apparatus depicted in FIGS. 1–18.

Figure 20:
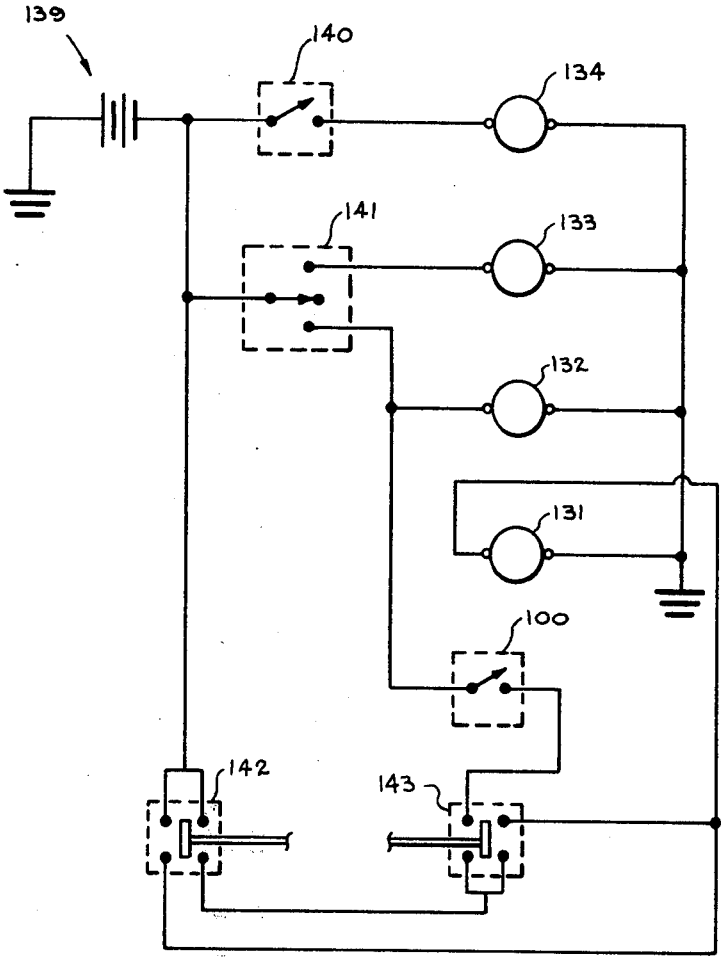

FIG. 20 is a functional diagram of an exemplary electrical circuit for controlling the apparatus depicted in FIG. 19.

DETAILED DESCRIPTION

Referring now to FIG. 1, there may be seen a pictorial illustration of that portion of a generally conventional sawmill which includes the sawmill carriage 2 arranged to receive sawlogs and the like from a loading rack or other assembly also depicted therein. More particularly, the sawmill carriage 2 may be seen to be composed of a bed 3 having a pair of knee assemblies 4 and 5 slidably mounted on rails 9 traversely positioned on the deck 53 of the bed 3. As may further be seen, the bed 3 of the carriage 2 is supported by wheels 8 adapted to engage and ride on rails 6 and 7 leading past a conventional rotary or circular saw blade 10 which, in turn, may be revolved by any suitable driving means not depicted in FIG. 1.

As will be clear from the following description, sawlogs are first disposed on a rack of suitable design (not depicted) which is located on the opposite side of the loading assembly and which includes provision for transferring logs one at a time onto cup-like members 21–22. Whenever a log is to be sliced into lumber, the stop and loader members 21–22 are rotated by the shaft 23 to dump the log lengthwise onto the struts 19–20, to roll forward onto the deck 53 of the carriage 2, where they are gripped in longitudinal position relative to the saw blade 10 by the knee assemblies 4 and 5. Accordingly, the sawmill carriage 2 is caused to move backwards and forwards along the rails 6 and 7 to carry the sawlog held by the knee assemblies 4 and 5 to and from the revolving saw blade 10, whereby the sawlog is sliced into lumber or other rectangular boards and planks. Any suitable means may be used to propel the sawmill carriage 2 towards and away from the saw blade 10, such as that depicted in the aforementioned U.S. Pat. No. 3,566,933.

Referring again to FIG. 1, the loading assembly depicted therein adjacent the carriage 2 may be composed of a pair of frame struts 11 and 12 arranged perpendicularly to the rails 6 and 7 and supporting a pair of saddle members 13 and 14. As will be apparent to those of experience in this art, the shaft or axle 23 carrying the stop and loader members 21 and 22 is preferably rotatably supported at each end by pillow blocks 24 and 25 resting on horizontal struts 19 and 20 which, in turn, are supported above the saddle members 13 and 14 at the near ends by a pair of relatively short vertical struts 16 and 18, and at their far ends by relatively tall vertical struts 15 and 17, whereby the struts 19 and 20 are tilted upward. Thus it is the function of the tilted horizontal struts 19 and 29 to support the ends of such log as it is rolled therealong onto the deck 53 of the sawmill carriage 2, as well as to slow down the log as it travels toward the knee assemblies 4–5. Sawlogs are necessarily produced in random sizes as well as shapes, and thus it frequently happens that the sawlog will be received which is too short to span the distance between the two spaced-apart horizontal struts 19 and 20. Accordingly, the assembly preferably includes a pair of U-shaped log support bars 28 and 29 intermediately arranged between the two horizontal struts 19 and 20, and supported by a pair of spaced-apart horizontal braces extending between and connecting the two frame struts 11 and 12, for the purpose of holding short sawlogs. In this respect, additional bracing may also be provided by members such as struts 30, 31 and 34, which extend between braces 26 and 27 and by the two angle braces 32 and 33 which extend between the brace 26 and the two vertical beams 15 and 17, respectively.

As hereinbefore explained, not all sawlogs received at the sawmill will have a perfectly round cross-section, nor will all sawlogs be relatively straight in configuration. Some will have large flattened or even convex areas on their circumferences; some will have a knot or other similar remainder of a branch as imperfections on their surfaces, and some may even have a curved, a dog-leg, or even an S-like longitudinal configuration. In such case, a log of such irregular configuration will not only tend to be over-slowed by the tilt of the struts 19 and 20 whereby it will not reach the knees 4 and 5; it may also not rest evenly against the two face plates 50 even if it does reach the two knees 4 and 5 of the carriage 2, whereby the two ends of the log may be gripped properly by the dogs extending outwardly from the face plates 50 of the two knees 4 and 5. It is conventional, therefore, to provide means for pushing or otherwise driving the sawlog firmly against the face plates 50 of the knees 4 and 5, whereby they may be more securely gripped by these dogs. It is further conventional to provide log-turning means for rotating the log both before and after it has been placed on the deck 53 of the sawmill carriage 2, in order to present the most suitable portion of its surface to engagement by the dogs.

Referring again to FIG. 1, there may be seen one embodiment of the present invention which is composed of an improved slapper bar assembly 35 arranged to arcuately swing over behind and following a sawlog discharged onto the deck 53 of the sawmill carriage 2, in order to drive such sawlog more firmly against the face plates 50 of the knees 4 and 5. Further, such slapper bar assembly 35 includes means for rotating the sawlog about its longitudinal axis while it is resting on or about the deck 53 of the sawmill carriage 2. As indicated in FIG. 1, this slapper bar assembly 35 is arcuately driven to and from the sawmill carriage 2 by means of a pneumatic or hydraulic cylinder 36 which is pivotally attached to or adjacent the strut 34 by any conventional means such as a clevis and clevis pin or the like. Also depicted in FIG. 1 is a second pneumatic or hydraulic cylinder 37 attached to the side of the slapper bar assembly 35 opposite the face portion containing the slot 38 through which the log-turning portion operates, as will hereinafter be explained in detail.

Referring now to FIGS. 2–4, there may be seen a functional and simplified pictorial representation of the slapper bar assembly 35 as operated in conjunction with the sawmill carriage 2 hereinbefore discussed. More particularly, it may be seen that a sawlog 45 of generally conventional configuration has been discharged onto the deck 53 of the carriage bed 3 and has been positioned in abutting proximity to the face plate 50 of the assembly, whereby such sawlog may be securely gripped by the upper and lower dogs 51 and 52 which retractably extend from the face plate 50 of the knee assembly 5. In this respect, it should be understood that the knee assembly 5 depicted in FIG. 3 is constructed to operate the same as the knee assembly 4 depicted in FIG. 1, and thus the sawlog 45 may be presumed to be simultaneously gripped by similar upper and lower dogs (not depicted) which also extend in like manner from the face portion of knee assembly 4. As more particularly depicted in FIG. 2, the slapper bar assembly 35 is preferably composed of a hollow rectangular steel member pivotally secured in a suitable manner to the brace 26 at the location functionally indicated in FIG. 2 as the pivot axis 55, and having an open slot-like aperture 38 in the upper portion of the surface or side which confronts the sawlog 45. Accordingly, the slapper bar assembly 35 may be caused to rotate arcuately about the pivot axis 55 by means of the pneumatic or hydraulic cylinder 36 which is pivotally attached to the opposite or rear side of the slapper bar assembly 35 by a suitable pivot link 56 which interconnects the slapper bar assembly 35 to the free traveling end of the piston rod 62 therein, the cylinder 36 being further secured to a conventional pivot axis 54, as may be seen in FIGS. 5–6. Thus, when the piston rod 62 is retracted within the cylinder 36, this will draw the slapper bar assembly down to permit sawlog 45 to be discharged from the loading rack onto the deck 53 of the sawmill carriage 2. Conversely, extension of the piston rod 62 will rotate the slapper bar assembly 35 in a counterclockwise manner to drive the sawlog 45 against the knee assembly 5, as suggested in FIGS. 4 and 5.

Referring again to the slapper bar assembly 35 as depicted in FIGS. 2–4, there may be seen to be a second pneumatic or hydraulic cylinder 37 which is fixedly secured to the rear side of the slapper bar assembly 35 by means of a bracket 58, and which has the free traveling end of its piston rod 57 attached to an L-shaped arm portion 60 of the log turner assembly 59 which is composed of elongated mandrel member 61 slidably disposed within the rectangular housing of the slapper bar assembly 35 and with three dog-like teeth located at its upper end to be extended through the slot-like aperture 38 in the slapper bar assembly 35 for spurring or otherwise engaging the surface of the sawlog 45 opposite the face plates 50 of the knee assembly 5. Accordingly, if it is desired to rotate the sawlog 45 after it has been deposited on the deck 53 of the sawmill carriage 2, this may be accomplished by extending the piston rod 62 to drive the upper end of the slapper bar assembly 35 against the sawlog 45, and thereafter retracting the second piston rod 57 into the cylinder 37 to drive the teeth 63–65 of the mandrel 61 in an upward scuffing manner against the surface of the sawlog 45 to cause it, to turn, to rotate in a counterclockwise direction.

It is preferable that the teeth 63–65 of the mandrel 61 be generally triangular in form, whereby lowering of the mandrel 61 within the housing of the slapper bar assembly 35 will draw the teeth 63–65 downward across the surface of the sawlog 45 without drawing the sawlog 45 backwards in a clockwise rotational direction. Also, as will hereinafter be explained, raising the mandrel 61 within the slapper bar assembly 35, by retracting the piston rod 57 within the cylinder 37, will also cause the teeth 63–65 to be extended through the slot-like aperture 38 from the slapper bar assembly 35, whereas extension of the piston rod 57 to draw the mandrel 61 downward through the slapper bar assembly 35 will also draw the teeth 63–65 into as well as downward through the rectangular housing of the slapper bar assembly 35.

As will hereinafter be explained in detail, it is desirable from the standpoint of effective utilization and operation of the present invention that the pivot axis 55 of the slapper bar be located in line with the cutting blade 10. Accordingly, and for this reason, it will be noted that the pivot axis 55 is located between the slapper bar 35 and the adjacent edge of the bed 3 of the carriage 2. Further, this arrangement permits the slapper bar 35 to be rotated, whereby the slapper bar 35 may be tilted forward from vertical to further facilitate urging the sawlog 45 against the knees 4 and 5.

Figure 6:
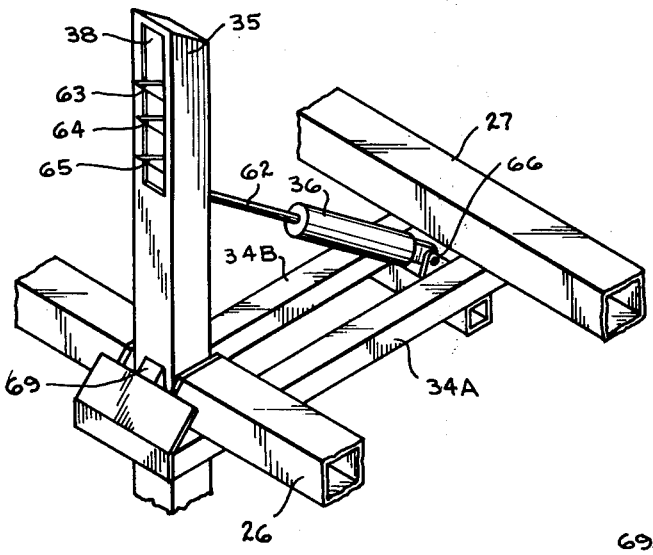
Figure 7:
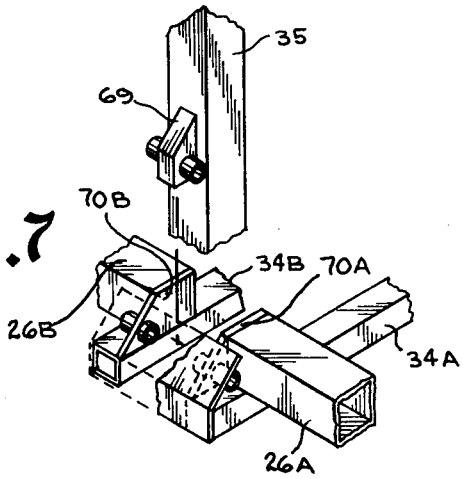
FIG. 7 is a more detailed and partially exploded representation of a portion of the apparatus depicted in FIGS. 5 and 6, to more particularly show how the slapper bar is preferably mounted on the loading mechanism portion of a sawmill.

Referring now to FIGS. 5–7, there may be seen a simplified but more detailed illustration of the combination slapper bar and log-turning apparatus hereinbefore discussed. It is a feature of this apparatus that the log-turning portion shall operate independently of, but in combination with, the slapper bar portion of the assembly. Accordingly, it will be noted that although the piston rod 57 is generally extended to draw the mandrel 61 downward within the rectangular housing of the slapper bar assembly 35, and to thereby retract the teeth 63–65 within the slapper bar assembly 35 whenever the other piston rod 62 is retracted to lower the slapper bar assembly 35, the first piston rod 57 may nevertheless be maintained in a distended position while the piston rod 62 is also distended to elevate the slapper bar assembly 35 to an erect position. The reason for this feature is that it is often necessary to swing the slapper bar assembly forward against a particular sawlog with great force, so as to drive it forward onto the deck 53 of the sawmill carriage 2. Since it is the portion of the slapper bar assembly 35 which tends to receive the impact of such force, and since this impact might damage or, at the least, cause the teeth 63–65 to become embedded in the surface of the sawlog, this is prevented from occurring by providing that the teeth 63–65 are retractable and lowerable within the slapper bar assembly 35, regardless of its posture as determined by the action of the cylinder 36 and piston rod 62.

Referring again to FIGS. 5–7, it may be seen that the pivot axis 55, which is functionally represented in FIGS. 2–4, may be provided by the combination of a hinge bracket 69 fixedly mounted on the forward face of the slapper bar 35 in the gap between the spaced-apart ends of the two struts 26. Thus, this gap is concealed in FIG. 1 by a canted plate covering two brackets 70, which are each fixed to the ends of the two struts 26, and which also rest on the ends of the struts 34A–B carrying the two struts 26. A pivot pin 67 (or a pair of such pins as indicated in FIG. 7) may be provided to couple the link 69 to the two brackets 70, whereby the slapper bar 35 rotates upward in the gap between the spaced-apart ends of the two struts 26.

The foregoing arrangement, although exemplary, has certain advantages in addition to those hereinbefore mentioned. First, it permits the slapper bar 35 to be located as far forward toward the carriage 2 as possible, when it is raised to its erect position. Second, when the slapper bar 35 is lowered to its supine position, as indicated more particularly in FIG. 5, it is disposed below a log which may be carried on the cup members 21–22, whereby any log thereon will clear the slapper bar 35 when it is dumped forward onto the struts 19 and 20.

Referring now to FIGS. 8–9, there may be seen a more detailed illustration of the combination slapper bar and log turning assembly depicted more generally in FIG. 1, and illustrating more particularly how the log turner assembly 59 may be composed of a mandrel 61 having an angular arm portion 60 at its lower end to which the piston shaft 57 may be attached, and a tooth bar 82 disposed fully within the rectangular housing of the slapper bar 35 and fastened to the mandrel 61 by one or more brackets 90–92. Since the function of the piston shaft 57 is to move the mandrel 61 partially in and out of the lower end of the slapper bar 35, rollers 80–81 and 86–89 may be conveniently provided to engage opposite interior surfaces of the rectangular housing of the slapper bar 35 to prevent damage because of friction.

Referring in particular to FIG. 9, there may be seen a more particular illustration of teeth 63–65 having a configuration suitable for the purposes of the present invention and conveniently secured to the upper end of the tooth bar 82 so as to extend outward through the slot 38 in the housing of the slapper bar 35 during retraction of the piston shaft 57 into the cylinder 37. More particularly, the teeth 63–65 may be seen to be pivotally attached along the upper end of the tooth bar by means of tooth brackets 83–85. As will hereinafter be explained in detail, the pivot point of the teeth 63–65 is preferably located in each instance so that the teeth 63–65 will naturally fall forward to extend out through the slot 38 whenever the tooth bar 82 is raised within the slapper bar 35 far enough to position the teeth 63–65 opposite the slot 38. On the other hand, what is required for the purposes of the present invention is that the teeth 63–65 tilt outwardly only so far as to permit their tips to engage the surface of the sawlog 45, and to thereafter be secured against further such tilting or rotation, whereby further upward movement of the piston shaft 57 will enable the teeth 63–65 to engage and rotate the sawlog 45 relative to the face plate 50 of each of the knee assemblies 4–5 in FIG. 1.

It may be seen that there are practical limits to the degree of rotation of the sawlog 45 which can be effected by a single upward stroke of the piston shaft 57. Not only can the shaft 57 be drawn only a limited distance into the cylinder 36, but the tooth bar 82 can travel upward only until the upper tooth 63 engages the upper end of the slot 38. Hence, it is often desirable to re-extend the piston shaft 57 at least one more time to further rotate the sawlog 45.

Referring now to FIG. 11, there may be seen a pictorial representation of the upper tooth 63 which also appears in FIGS. 8–10 and which is exemplary in configuration of all three such teeth 63–65. More particularly, it will be seen that a tooth of such a shape will have its pivot axis located near its rectangular corner, whereby the short side 63A of the tooth 63 will move into abutting engagement with the adjacent edge of the tooth bar 82, whenever the tooth 63 is extended to engage a sawlog. Thus, the tooth 63 is permitted to rotate counterclockwise only far enough to be capable of engaging the log, but it cannot rotate further.

It will also be apparent from FIG. 9, however, that without special provision, the teeth 63–65 will tend to remain in a folded upwardly-extending position even when the slapper bar 35 is elevated to substantially a vertical position. In this instance, provision to cause the teeth 63–65 to fall into a log-engaging position of their own accord is preferably made by adding one, and preferably two, laterally-extending wings or counterweights 93A and B, which tend to swing the tooth 96 around whenever the slapper bar 35 is moved to merely a partially erect position.

As indicated in FIG. 10, the blade portion of the tooth 93 is preferably of about the same width as that of the tooth bar 82, and thus the spacing between the two counterweights 93A–B is greater than such width to permit the tooth 93 to pivot freely between its mounting brackets 83A–B.

Referring again to FIGS. 1–8, it will be noted that the slapper bar 35 is depicted as having a rectangularly-shaped housing. Insofar as its adaptability for driving logs is concerned, the slapper bar 35 may have any of various cross-sectional configurations, of course, but a rectangular housing has been found to have certain advantages to the present invention. In particular, there is a tendency for the teeth 63–65 to wobble slightly when engaging a sawlog, and this, in turn, tends to damage the pivot pins. If the counterweights 93A–B on the tooth 63 are provided with flat edges, as indicated in FIGS. 8–11, these counterweights 93A–B can also function as aligning guides if the slapper bar 35 has a rectangularly-shaped housing. Alignment of the tooth bar 82 and mandrel 61 is achieved by mounting the roller sets 80–81 and 86–89 on pivot pins having lengths corresponding to the span of the counterweights 93–95, and with rounded ends to prevent binding with the inside of the housing of the slapper bar 35, as illustrated in FIG. 10.

Referring again to FIG. 8, it may be seen that the brackets 83–85 for the purpose of better accommodating pivotal movement of the teeth 63–65 relative to the tooth bar 82, and that the rollers 80–81 and 86–89 are also preferably provided in pairs for the purpose of facilitating balanced travel of the mandrel 61 and tooth bar 82 within the slapper bar 35. Referring in particular to FIG. 10, it may be seen that the bracket 83, for example, is actually preferably formed of a pair of matching brackets 83A–B which are mounted on opposite sides of the tooth bar 82, whereby the tooth 63 may be pivotally mounted between the two brackets 83A–B by a pin or other suitable means for more stable rotation and support when engaging the surface of a heavy saw log. Similarly, the roller 80 is preferably composed of a pair of rollers 80A–B which are mounted on opposite sides of the tooth bar 82 to better maintain its position within the slapper bar 35 during movement of the piston shaft 57.

Referring again to FIGS. 2–4, it should be noted that the actuating cylinder 37 is preferably mounted on the slapper bar 35 substantially equidistantly with respect to the pivot point 55 of the slapper bar 35. The purpose for this feature of the invention is that components of the type of cylinder 37 are subject to damage from the force of impacts which are commonly experienced by the slapper bar 35 during merely ordinary usage. Not only will such impacts cause damage to seals and the like, but the rod 57 may become deformed, or even disengaged from the mandrel 61. When the cylinder 37 is mounted on the slapper bar 35 with its center of gyration (its center of weight with the rod 62 extended) greatly reduces the adverse effect of such impacts on the cylinder 37.

Referring again to FIG. 8, it will be noted that both ends of the tooth bar 82 are alike insofar as the arrangement of the roller sets 80–81 and 86–87 are concerned, and also insofar as the arrangement of brackets 83–85 and 90–92 are concerned. It will occasionally happen that one or more of the teeth 63–65 may become disconnected from the tooth bar 82 during usage, whereupon it becomes necessary to shut down the saw mill until repairs can be made. The configuration of the teeth 63–65 is such that they themselves are rarely damaged by ordinary usage, and thus what is generally broken under ordinary circumstances is the bracket by which the tooth is secured to the tooth bar 82.

Only one of the three brackets 90–92 is actually necessary to effectively connect the tooth bar 82 to the mandrel 61, and since all of the brackets 83–85 and 90–92 are intentionally made identical to each other, a quick repair of the apparatus depicted in FIGS. 8–9 may be effected by reversing the position of the tooth bar 82 within the slapper bar 35, and by securing the tooth bar 82 to the mandrel 61 by the unbroken ones of the three brackets 83–85. Accordingly, the teeth 63–65 may then be secured to the tooth bar 82 by means of brackets 90–92, and the saw mill may then be returned to operation after a minimum shut-down time.

Referring now to FIGS. 12–15, it will be seen how the present invention can be employed in a particularly expeditious manner when it is sought to handle the cutting of timbers and the like from logs of the larger diameters. In particular, FIG. 12 provides an illustration of how the slab or segment Y is initially taken from the sawlog 45, and how the sawlog 45 is thereafter rotated to the position in FIG. 12 for the purpose of taking the second slab X.

As is well known in the industry, slabs X and Y generally have no potential value as a source of lumber, and thus these two portions of the sawlog 45 may be carried away to a chipper, not depicted herein, by conventional means also not depicted herein. The next cut made on the sawlog 45 will, however, produce the slab or segment W, which obviously does have value as a source of lumber, however, and which is desirably retained at or adjacent the carriage 2 rather than being discharged to the chipper (not depicted). On the other hand, the cant Z is already positioned on the carriage 3 to be cut into lumber, and if the slab W is not moved out of the way, its presence will hinder cutting of the cant Z. Prior to availability of the present invention it was usually necessary to suspend operations until the slab W could be manually lifted out of the way, and after the cant Z was disposed of it was again necessary to suspend operations until the slab W could be lifted back to the deck 53 of the carriage 2. Accordingly, it is a further feature of the present invention that it can be employed, in conjunction with other conventional components of the sawmill, to perform this task mechanically, and further to perform this task without any need for suspending operations.

Referring now to FIG. 13, there may be seen a simplified pictorial representation of the portion of the sawlog 45, after removal of slabs X and Y, and after the remaining portions are composed of only the cant Z and the slab W. As is further indicated in FIG. 12, the saw blade 10 will often not cut the slab W completely free of the cant Z, and thus it may be necessary to separate the slab W by lifting the teeth 63–65 while the slapper bar 35 is held against the slab W. After the slab W is separated from the cant Z, however, it may conveniently be laid back on the stop and loader members 21 and 22, as illustrated in FIG. 14.

It is usually desirable to cut further slabs from the cant Z, to provide it with a squared or rectangular cross-sectional configuration, before cutting it into timbers or lumber. Accordingly, and as further indicated in FIG. 15, the stop and loader members 21 and 22 may be rotated in a clockwise direction by means of the shaft 23, whereby the slapper bar 35 may be repositioned against the cant Z without disturbing the slab W on the stop and loader members 21 and 22. After the cant Z has been disposed of, the slapper bar 35 is returned to the position depicted in FIG. 14, and the stop and loader members 21 and 22 may be rotated in a counterclockwise manner to reposition the slab W onto the slapper bar 35. Thereafter, the slapper bar 35 may be employed to dispose the slab W onto the deck 53 of the carriage 2, whereby it may thereafter be cut into lumber as hereinbefore explained.

Referring again to the apparatus depicted in FIGS. 8–10, it will be clear from the foregoing description that although the slapper bar 35 may be suitably provided with a rectangular-shaped housing, that such housing may be round or oval-shaped without substantial loss of any of the various features and advantages of the present invention. As hereinbefore stated, the principal function of the counterweights 93A–B, on the tooth 63 depicted in FIG. 11, is to rotate the tooth 63 outwardly of the slapper bar 35 whenever such tooth 63 is positioned adjacent the slot 38, and the fact that such counterweights 93A–B also act as alignment guides to prevent the tooth 63 from wobbling on the tooth bar 82, when driven into or along the surface of a sawlog, is secondary to such primary purpose or function of rotating the tooth 63. Accordingly, the rectangular configuration of such counterweights 93A–B as illustrated in FIGS. 10 and 11 herein is related only to such secondary function of aligning the tooth 63 by guiding on the flat interior surfaces of the rectangular housing of the slapper bar 35 as illustrated in FIG. 8. If the slapper bar 35 is provided with a round or oval-shaped housing as hereinabove proposed, it will be apparent that these counterweights 93A–B must then be reshaped, and shortened, to permit the tooth 63 to rotate within the housing of the slapper bar 35, and that this may require sacrifice of the aforementioned secondary function. On the other hand, it will also be apparent that provision against wobble is only necessary when the tooth 63 is impacted against a sawlog, and thus such alignment may be achieved by the slot 38 through which the tooth 63 will extend.

It will be further apparent that, although the apparatus hereinbefore described and depicted has been discussed with regard to its use in conjunction with transferring a sawlog between the stop and loader members 21–22 and the sawmill carriage 2, or in conjunction with manipulating a sawlog positioned on the deck 53 of the carriage 2, that such apparatus may usefully be employed for manipulation of the sawlog, or of timbers or lumber cut therefrom, at various other convenient locations throughout the sawmill. Furthermore, the usefulness of such apparatus is obviously not limited to the environs of a sawmill, but will have suitable application in other types of operations and systems.

The teeth 63–65 may have different overall configurations without necessarily limiting the features and advantages of the present invention. As indicated in FIGS. 9 and 11, however, a particularly suitable configuration is one wherein the tooth 63 is a relatively flat body formed in the manner of a right triangle, and wherein the tooth 63 is mounted on the tooth bar 82 so as to cause the side corresponding to the longer leg of the right angle portion of the triangle to engage the sawlog during upward travel through the slot 38, rather than the side corresponding to the hypotenuse of the triangle. The pivot hole in the tooth 63 is preferably located at the apex of this right angle, whereby the side of the tooth 63 corresponding to the short leg of the right angle is located adjacent to the edge of the tooth bar 82 when the tooth 63 is extended through the slot 38, and whereby the log-engaging side corresponding to the longer leg is adjacent the edge of the tooth bar 82 when the tooth 63 is folded within the housing of the slapper bar 35. Accordingly, the counterweights 93A–B are preferably located along the hypotenuse adjacent the end of the short leg of the triangle, to shift the center of balance of the tooth 63 away from both the pivot hole and the pointed end formed by the hypotenuse and the longer leg of the right triangle. With this arrangement, the tooth 63 will literally fall forward out through the slot 38, whenever the tooth 65 is positioned at the slot 38, and irrespective of how the slapper bar is positioned between the postures as shown in FIG. 2 and FIG. 4.

Referring now to FIGS. 18 and 19, there may be seen an illustration of exemplary apparatus for rotating the shaft 23 which supports the stop and loader members 21 and 22 as indicated in FIGS. 13–15. More particularly, the free traveling end of the piston arm 113, of the cylinder 112, is preferably provided with a clevis and pin assembly 111 which, in turn, is pivotally connected to a lever arm 110A for rotating the shaft 23. Accordingly, when pressure is supplied to the cylinder 112 through line 112B, and when line 112A becomes the exhaust line as hereinbefore described, the piston arm 113 will be extended to rotate the stop and loader members 21–22 away from their normal position whereby a log carried thereon will be dumped away from the log deck (suggested but not depicted) to roll toward the carriage 2. Alternatively, when line 112A becomes the pressure route and line 112B provides exhaust, the piston arm 113 will retract to rotate the stop and loader members 21–22 from the second position as illustrated in FIG. 19, to their first position.

The lever arm 110A may, of course, be connected directly to the shaft 23 which is being rotated. As depicted in FIG. 18, however, the lever arm 110A may be connected to one or the other of the two stop and loader members 21–22 by means of a spacing block 110B which positions the end of the lever arm 110A for interconnection with the clevis and pin assembly 111.

As further indicated in FIG. 19, the port U of the cylinder 112 is coupled to the outlet C of a solenoid-actuated valve 124 by way of conduit 112A, and port V of the cylinder 112 is coupled to outlet D of the valve 124 by way of conduit 112B. The intake port B of the valve 124 is connected to a supply 120 of pneumatic pressure by way of conduit 120A, and its other outlet port A is open to the atmosphere. The valve 124 is normally positioned to interconnect ports B and C, whereby the piston arm 113 is normally retracted into the cylinder 112. When the valve 124 is actuated as hereinafter explained, however, ports B and D will be interconnected to extend the piston arm 113, and ports A and C will be connected to provide the cylinder 112 with an exhaust route by way of line 112A and port U. When the valve 124 is de-activated, it is spring-loaded to return to its former position whereby the piston arm 113 is again retracted into the cylinder 112.

Referring now to FIG. 20, there may be seen a simplified schematic diagram of electrical control circuitry which is suitable for purposes of the present invention. In particular, it will be seen that such circuitry may include a spring-loaded switch 140, which may be located in any suitable place such as in a central control room (not depicted), is interconnected between a suitable power source 139 and the solenoid 134 of the valve 124 illustrated in FIG. 19. Accordingly, closing the switch 140 will energize the solenoid 134 to change the position of the valve 124, whereby pressure will now be coupled between ports B and D therein to the port V in the cylinder 112, and whereby port U is now the exhaust port and is coupled through ports C and A of the valve 124, port A being open to the atmosphere. In this arrangement, the piston shaft 113 will now be distended from the cylinder 112 to rotate the shaft 23 and stop and loader members 21–22 toward the carriage 2 to a position whereby they can block the logs on the log deck (suggested in FIGS. 13–14 but not depicted therein) from rolling onto the stop and loader assembly.

As hereinbefore explained, the stop and loader members 21 and 22 are normally positioned to recive a log from the log deck (not depicted), and since the valve 124 is spring-loaded to a position wherein ports B and C are interconnected, a log may be taken onto the stop and loader members 21 and 22 by merely releasing the switch 140. After receipt of a log, switch 140 may be closed to actuate the solenoid 134 which, in turn, repositions the valve 124 to extend the piston arm 113 to rotate the stop and loader members 21 and 22 toward the carriage 2 depicted in FIG. 1. This, in turn, will dump the log onto the rails or struts 19 and 20 whereby it will roll onto or at least near to the carriage 2. Thereafter, the switch 140 may be released to permit the stop and loader members 21 and 22 to rotate back to their earlier normal position.

If the log dumped onto the struts 19–20 does not roll fully onto the deck 53 of the carriage 2, it may be driven thereon by rotating the slapper bar 35 against it by means of cylinder 36. Assuming that the slapper bar 35 is positioned as indicated in FIG. 2, and that the piston rod 62 is retracted within cylinder 36 as indicated in FIG. 19, the sawmill operator may position the arm of switch 141 to couple power through the solenoid 133 of the "bar-up" valve 121, whereby the valve 121 will be repositioned to couple pressure from line 120A through ports B and E through line 121B to port X of the cylinder 36, and port W will now be coupled through line 121A, and ports D and A of the valve 121, to the atmosphere. Accordingly, pressure in line 121B will distend the piston arm 62 from the cylinder 36 to drive the slapper bar 35 toward the erect position as suggested in FIG. 3.

It may be further noted that port C of the valve 121 is also interconnected through line 121C to the intake port A of the "bar-down" valve 122 which may have two outlet ports B and C as indicated in FIG. 19. Only port C of valve 122 is open to the atmosphere, however, and since the valve 122 is positioned to connected intake port A with plugged outlet port B when its actuating solenoid 132 is inactivated, line 121C is effectively disconnected or blocked insofar as cylinder 36 is concerned.

Referring again to FIG. 20, it will be seen that both the "bar-up" valve 121 and the "bar-down" valve 122, which are respectively actuated by solenoids 133 and 132, are controlled by a three-position switch 141. The normal position of the "bar-up" valve 121 is with port B connected to port D and port E connected to port C. Accordingly, whenever the arm of switch 141 is moved to its upper contact to actuate the solenoid 133, pressure will be applied to the cylinder 36 to extend the piston arm 62, as hereinbefore explained, and whenever the arm of switch 141 is moved to its lower contact to inactivate the solenoid 133 and activate solenoid 132, the "bar-down" valve 122 will shift to provide an exhaust route from port X of the cylinder 36 through line 121C and ports A and C of the valve 122 to retract the piston arm 62 into the cylinder 36. On the other hand, the arm of switch 141 may be moved to its neutral or center contact to immobilize the slapper bar 35 at any desired intermediate position by closing both the exhaust line 121C and the pressure route provided by line 121A, whereby pressure is equalized on both sides of the piston portion of the arm 62 in the cylinder 36.

It is a feature of the present invention to provide for absolute immobilization of the slapper bar 35, and especially so when the bar 35 is in its retracted or supine position, since any upward movement of the bar 35 from this position will block any transfer of sawlogs from the stop and loader arms 21–22 to the carriage 2. It will be apparent to those with experience in this art that any imbalance in the pressure on the piston will cause the slapper bar 35 to move, and that such imbalance can arise for various reasons including but not limited to leakage in the seals in the cylinder 36 or through valve 121. This problem, which is not present in the apparatus of the prior art and which arises only because of the pressure equalization feature in the operation of cylinder 36, is overcome by the inclusion of a wand-actuated safety switch 100 which, as will be explained with regard to FIGS. 16–17, is closed whenever the slapper bar 35 is placed in or near either its fully erect position or its fully supine position.

Referring more particularly to FIG. 20, it will be seen that even though the bar control switch 141 is placed in its neutral condition, closure of this safety switch 100 will reapply electrical power to the solenoid 132 to return the "bar-down" valve 122 to its activated condition wherein ports A and C therein again become connected to couple port X of the cylinder 36 to the atmosphere. This consequent reduction of pressure in this side of the cylinder 36 will cause the piston arm 62 to return into the cylinder 36 to thereby pull the slapper bar 35 back down below the log on the stop and loader members 21–22 whenever the slapper bar 35 is placed approximate its fully supine position.

As hereinbefore stated, it is another feature of the present invention that the slapper bar 35 is not only capable of being moved to an erect vertical position as suggested in FIG. 3, but that it may actually be further tilted forward an additional 5–10 degrees, more or less. Although this is a distinct advantage whenever a malformed sawlog must be handled, whenever the slapper bar 35 is raised to its extreme end of its travel in this direction it tends to be tilted across the cutting line defined by the rotary saw 10. Accordingly, it is necessary to retract the slapper bar 35 at least slightly back of this cutting line whenever the saw log is carried to the saw blade 10 to prevent it from being struck by the adjacent edge of the carriage 2 upon return of this component from the saw blade 10.

If the apparatus is working as intended, the slapper bar 35 may be withdrawn and immobilized at a safe position behind the cutting line defined by the saw blade 10, after the log has been secured by the dogging teeth 51–52 of the knee assemblies 4–5. As hereinbefore stated, however, pressure leakage in the system may cause the "immobilized" slapper bar 35 to creep forward to interfere with the carriage 2. If the switch 100 is closed by movement of the slapper bar 35 before it can move into such position, however, the "bar-down" valve 122 will again shift as hereinbefore described to draw the slapper bar 35 back away from across the cutting line where it might otherwise be struck by the returning carriage 2.

Referring now to FIGS. 16 and 17, there may be seen a simplified pictorial illustration of an exemplary form of means for actuating the aforementioned safety switch 100 whenever the slapper bar 35 is at or near either its fully erect or its fully supine or reclining positions, but not whenever the bar 35 is between these two extreme limits of its travel. More particularly, the actuating means will be seen to be composed of a flap or bar member 102, which is pivotally interconnected at one end with the slapper bar 35 by a hinge 103, and which has a bent or hook-like portion at its other end. Accordingly, whenever the slapper bar 35 is moved into its upper range of travel, the bar member 102 will be lifted up from the wand 101 of the switch 100 by being dragged onto the strut 26 of the stop and loader assembly depicted in FIG. 1. As depicted in FIG. 16, however, further forward travel of the slapper bar 35 will eventually cause the hook-like end of the bar member 102 to catch and displace the wand 101 of the switch 100, whereupon the "bar-down" valve 122 will be shifted to cause the slapper bar 35 to move in a reverse direction. It will be noted, however, that reverse movement of the slapper bar 35 will only continue until the hook-end of the member 102 releases the wand 101 of the switch 100, whereupon the "bar-down" valve 122 reverts to its inactivated condition.

During any travel of the slapper bar 35 between its two extreme positions, the actuating member 102 will dangle freely away from the wand 101 of the safety switch 100. As indicated in FIG. 17, however, when the slapper bar 35 moves near to its fully supine position the actuating member 102 will again move against the wand 101 of the safety switch 100 to again actuate the "bar-down" valve 122, as hereinbefore explained, to prevent unwanted rise of the slapper bar 35 from this position. Any type of component may be employed as the safety switch 100, but it will be apparent that the switch 100 is preferably such that it is closed whenever the wand 101 is moved only slightly in any direction.

Referring again to FIG. 20, it will be seen that the safety switch 100 is effective for its intended purpose only when the slapper bar control switch 141 is in its center or neutral position. In other words, if the control switch 141 is positioned to connect power to the solenoid 132, the "bar-down" valve 122 will be actuated regardless of whether the safety switch 100 is open or closed. Similarly, when the control switch 141 actuates the "bar-up" valve 121, both the pressure and exhaust lines 121A–B are opened through the "bar-up" valve 121, and the line 121C is blocked. Accordingly, it is immaterial whether the safety switch 100 is open or closed whenever the "bar-up" valve 121 is actuated, whereby the slapper bar 35 can be moved to its extreme forward position whenever desired.

Referring again to FIGS. 19 and 20, it will be noted that the log turner portion of the slapper bar 35 is controlled by either of two switches 142–143 which, because a sawmill operator may be either left-handed or right-handed, are preferably arranged and interconnected to be actuated by moving a control lever (not depicted) which is preferably the same lever which operates the aforementioned control switch 141. More particularly, the lever is customarily vertically arranged to actuate the "bar-up" valve 121 when tilted forward of "neutral," to actuate the "bar-down" valve 122 when tilted rearwardly toward the sawmill operator. In addition, the lever will close or reposition the first rotator switch 142 when tilted to the left from "neutral," or will reposition the second rotator switch 143 when tilted to the right, but, as will hereinafter be explained, either of the two rotator switches 142 and 143 will cause elevation of the tooth bar 82 and extension of the teeth 63–65 when so repositioned, and only one of these two switches is operable at a time.

Referring again to FIGS. 19 and 20, it will be seen that when the two spring-loaded rotator switches 142 and 143 are in their normal or relaxed positions, the right-hand pair of contacts of switch 142 will be closed, and the left-hand pair of contacts of switch 143 will be closed. Thus, power will be coupled through both switches 142 and 143 to the normally open safety switch 100, but will also be disconnected from the solenoid 131 which actuates the rotator control valve 123. When the valve 123 is in its normal relaxed condition, however, ports B and C are interconnected to pass pressure from line 120A, to and through line 123A to port Y of the actuating cylinder 37, and to connect port Z therein and line 123B to the atmosphere by way of ports A and D. Accordingly, the piston rod 57 will be fully distended whenever switches 142 and 143 are in their normal relaxed position, as hereinbefore described, and the teeth 63–65 will be withdrawn into the housing of the slapper bar 35. When either switch 142 is positioned to close its left-hand pair of contacts, however, or switch 143 is shifted to close its right-hand pair of contacts, power will then be coupled through the repositioned switch to energize the solenoid 131. Accordingly, the rotator control valve 123 will then be repositioned to interconnect port B with D, and port A with port C, therein. Line 123A now becomes the exhaust line for the cylinder 37, and pressure through lines 120A and 123B will retract the piston shaft 57 into the cylinder 37 to raise and extend the teeth 63–65 from the slapper bar 35.

As hereinbefore stated, it is a feature of the invention that cylinders 36 and 37 are operable independently of each other. This will be apparent when it is seen that repositioning either switch 142 to close the left hand pair of contacts, or switch 143 to close the right-hand pair of contacts, will connect power directly to solenoid 131 irrespective of the position of either the safety switch 100 or the slapper bar control switch 141. On the other hand, if the switches 141–143 are all interconnected with a tilt bar or lever (not depicted) as hereinbefore explained, then switch 141 may not only be repositioned independently of either switch 142 or 143, but it may also be operated in conjunction therewith. In other words, the lever may be tilted forward to elevate the slapper bar 35 and may also be further shifted to either left-forward or right-forward to also extend the teeth 63–65 to rotate the saw log being held in position by the elevated slapper bar 35.

It should be noted that, although the control switch 141 is interconnected to override the safety switch 100, this will occur only when the control switch 141 is in either the "bar up" or "bar down" positions, as hereinbefore stated. In ordinary operation of the apparatus in FIG. 1, it will be noted that the slapper bar 35 will necessarily have to be retracted at least slightly to permit the teeth 63–65 to be extended and moved upward. Accordingly, this requires that the slapper bar 35 be immobilized in a position wherein the safety switch 100 is actuated by the hook-like end of the bar member 102. Referring now to FIG. 20, it may be seen that this disadvantage has been overcome by providing for disconnection of the safety switch 100 whenever the solenoid 131 is actuated. More particularly, it may be seen that whenever the right-hand contacts of switch 142 (or the left-hand contacts of switch 143) are opened, power is disconnected to both the safety switch 100 and the "bar-down" solenoid 132, whereby the slapper bar 35 becomes immobilized due to the pressure equalization feature provided by valve 121 and cylinder 36, whenever the log turning cylinder 37 is actuated.

Other variations and modifications will, of course, suggest themselves to persons having familiarity with the operating details of a sawmill. Accordingly, the various structures and techniques disclosed in the accompanying drawings and described in the specification are exemplary only and are not intended as limitations on the scope of the present invention.

What is claimed is:

1. An improved stop and loader assembly for use in a sawmill having a rotatable saw blade and the like, and further having a carriage movable to and from said saw blade, comprising a rotatable shaft aligned with and spaced laterally from said carriage, a pair of stop and loader members mounted in a spaced-apart manner on said shaft and formed to receive and support a sawlog and the like, a plurality of spaced-apart rail members supporting said shaft and extending perpendicularly between and tilting upward from said shaft to said carriage, a pair of spaced-apart support members aligned beside said carriage in an end-to-end relationship to each other, a tubular member having a sidewall aperture adjacent one end rotatable generally arcuately in a vertical plane perpendicular to said shaft about a pivot point aligned with said saw blade and located generally between the adjacent ends of said spaced-apart support members, first actuating means for rotating said tubular member between a substantially erect position wherein said tubular member is disposed between said support members and said sidewall aperture therein confronts said carriage and a generally reclining position lower than any sawlog supported on said stop and loader members, log turning means movable longitudinally in said tubular means and having a log engaging portion extendable outwardly through said sidewall aperture and retractable within said tubular means, and second actuator means for moving said log turning means in said tubular means.

2. The stop and loader assembly described in claim 1, wherein said log turning means comprises a connecting member having one portion interconnected with said second actuator and having another portion located in said tubular member adjacent said sidewall aperture therein, and at least one dogging member pivotally connected with said another portion of said connecting member thrustable through said sidewall aperture and against a saw log and the like by movement of said connecting member longitudinally in said tubular member to said sidewall aperture and retractable through said sidewall aperture and within said tubular member by movement of said connecting member longitudinally in said tubular member from said sidewall aperture.

3. The log turning means described in claim 2, wherein said dogging member is further interconnected with said connecting member for engaging and rotating said saw log during movement of said connecting means in one direction along said tubular member and for disengaging from and yielding to said saw log during movement of said connecting means in the other direction.

4. An improved stop and loader assembly for use at a first location in a sawmill having a saw blade rotatable in a cutting line at a second location therein and further having a log carriage movable adjacent said cutting line between said locations, comprising a rotatable shaft parallel to and displaced from said cutting line at said first location and having a pair of generally crescent-like stops and loader members fixedly located adjacent each end, a pair of spaced-apart rail members supporting said shaft and extending between said rotatable shaft and said cutting line, an elongate slapper member pivotally mounted between said rail members for arcuate movement between a first generally reclining position adjacent and lower than said rotatable shaft to a second generally erect position wherein said slapper member is tilted from vertical across said cutting line, log turning means slidably positioned in and retractably extendable from the upper end of said slapper member toward said cutting line, first actuating means for arcuately moving said slapper member, second actuating means for rotating said shaft and stop and loader members, third actuating means interconnected with said log turning means, and control means interconnected with said actuating means.

5. The stop and loader assembly described in claim 4, wherein said control means comprises a first switching means having a neutral position for causing said first actuating means to immobilize said slapper member, a bar-up position for causing said first actuating means to drive said slapper member toward said generally erect position, and a bar-down position for causing said first actuating means to drive said slapper member toward said generally reclining position, and a second switching means interconnected with said first switching means for causing said first actuating means to drive said slapper member toward said generally reclining position.

6. The stop and loader assembly described in claim 5, wherein said first switching means overrides said second switching means when said first switching means is moved to said bar-up position.

7. The stop and loader assembly described in claim 6, wherein said second switching means comprises a limit-type switch located adjacent said pivot point of said slapper member, and operable when said first switching means is in said neutral position, and engaging means hingedly interconnected with said slapper member for engaging said limit switch when said slapper member is substantially in said generally erect and reclining positions and for disengaging said limit switch when said slapper member is in an intermediate position between said generally erect and reclining positions.

8. The stop and loader assembly described in claim 7, wherein said first actuating means comprises a source of pneumatic pressure, a pneumatic cylinder and piston assembly interconnected with said slapper member, and valve means interconnected with said limit-type switch for connecting pressure from said source to actuate said cylinder and piston assembly when said first switching means is in said bar-up and bar-down positions and to equalize the pressure in said cylinder and piston assembly when said first switch is in said neutral position and said engaging means is disengaged from said limit-type switch.

* * * * *